US008297261B2

(12) United States Patent
Steinbach et al.

(10) Patent No.: US 8,297,261 B2
(45) Date of Patent: Oct. 30, 2012

(54) METHOD AND DEVICE FOR CONTROLLING A FUEL-SUPPLY SYSTEM

(75) Inventors: Timo Steinbach, Stuttgart (DE); Dorothee Sommer, Stuttgart (DE); Stefan Kieferle, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 45 days.

(21) Appl. No.: 12/734,531

(22) PCT Filed: Oct. 16, 2008

(86) PCT No.: PCT/EP2008/063976

§ 371 (c)(1),
(2), (4) Date: Aug. 24, 2010

(87) PCT Pub. No.: WO2009/062805

PCT Pub. Date: May 22, 2009

(65) Prior Publication Data

US 2010/0307459 A1 Dec. 9, 2010

(30) Foreign Application Priority Data

Nov. 13, 2007 (DE) ..... 10 2007 054 094
Apr. 17, 2008 (DE) ..... 10 2008 001 240

(51) Int. Cl.
*F02M 37/08* (2006.01)

(52) U.S. Cl. ..... 123/514; 123/497; 123/457

(58) Field of Classification Search ..... 123/514, 123/497, 509, 457, 459, 506, 461, 496, 510, 123/511, 495
See application file for complete search history.

(56) References Cited

U.S. PATENT DOCUMENTS

| | | | | |
|---|---|---|---|---|
| 5,411,002 | A * | 5/1995 | Smitley | 123/497 |
| 5,850,818 | A * | 12/1998 | Yoshiume et al. | 123/497 |
| 6,412,475 | B1 | 7/2002 | Joos et al. | |
| 7,278,404 | B2 * | 10/2007 | Wolters et al. | 123/514 |
| 7,406,950 | B2 * | 8/2008 | Sawut et al. | 123/497 |
| 2002/0040704 | A1 * | 4/2002 | Onishi et al. | 123/446 |
| 2005/0115533 | A1 | 6/2005 | Okamoto et al. | |
| 2007/0246020 | A1 * | 10/2007 | Sawut et al. | 123/495 |

FOREIGN PATENT DOCUMENTS

| | | | |
|---|---|---|---|
| DE | 42 29 409 | | 3/1994 |
| DE | 10 2005 023 700 | | 11/2006 |
| FR | 2 797 309 | | 2/2001 |
| JP | 59-122733 | | 7/1984 |
| JP | 04241764 | A * | 8/1992 |
| WO | WO 2006 125 702 | | 11/2006 |

* cited by examiner

*Primary Examiner* — Mahmoud Gimie
(74) *Attorney, Agent, or Firm* — Kenyon & Kenyon LLP

(57) ABSTRACT

In a method for controlling a fuel-supply system, a first supply unit supplies fuel from a storage container to a second supply unit. At least a partial quantity of the fuel quantity supplied by the first supply unit returns to the storage container as return quantity via a return line. The return quantity is determined as a function of the operating state of the fuel-supply system. The first supply unit is controlled at least as a function of the return quantity.

29 Claims, 3 Drawing Sheets

METHOD AND DEVICE FOR CONTROLLING A FUEL-SUPPLY SYSTEM

BACKGROUND OF THE INVENTION

1. Field of the Invention

The present invention relates to a method and a device for controlling a fuel-supply system.

2. Description of Related Art

From German patent application document DE 10 2005 023 700, a device and a method for controlling a fuel-supply system are known. In that particular fuel-supply system, a first supply unit supplies fuel from a reservoir to a second supply unit. At least a partial quantity of the fuel quantity supplied by the first supply unit is returned to the reservoir as return quantity via a return line.

In modern Diesel injection systems, the second supply unit, hereinafter also referred to as high-pressure pump, must be cooled and lubricated by fuel. This calls for a minimally required quantity of fuel, which is returned to the reservoir via the return line. Furthermore, the first supply unit, hereinafter also referred to as electric fuel pump, must convey the injected fuel quantity from the reservoir into the high-pressure pump.

For economic reasons, the electric fuel pump should supply only the absolutely required fuel quantity. If too much fuel is supplied, then this results in unnecessary fuel consumption. Furthermore, it leads to undesired heating of the fuel. For this reason, the supply quantity of the electric fuel pump is normally specified as a function of the operating state and the component tolerance system, in such a way that a desired fuel quantity is supplied. Moreover, the return quantities are used for keeping the reservoir filled, regardless of the fluid level of the tank, via active cup filling systems, e.g., a sucking jet pump.

To satisfy these requirements, the related art provides for a regulation of the pressure in the return line. The disadvantage of this related art is that the threshold value for the return quantity must be specified while taking large tolerances into account. This results in an unnecessary expenditure of electrical drive capacity in certain operating states.

BRIEF SUMMARY OF THE INVENTION

In a method or a device for controlling a fuel-supply system according to the present invention, a first supply unit supplies fuel from a reservoir to a second supply unit. At least a partial quantity of the fuel quantity supplied by the first supply unit is returned to the reservoir as return quantity via a return line. According to the present invention, return quantity (MR) is determined as a function of the operating state, and the first supply unit is controlled as a function of at least the return quantity. Depending on the configuration, it may be necessary to consider not only the return quantity but possibly also the fuel quantity to be injected into the internal combustion engine.

This procedure has the advantage that the electrical drive output is able to be reduced considerably because the supply quantity of the electric fuel pump is able to be adjusted to the minimally required quantity as a function of the return pressure. Furthermore, reducing the return quantity makes it possible for the sucking jet pump to aspirate less fuel in the tank, which leads to a higher mixture temperature in the aspiration region of the EFP, especially at lower temperatures, and thus promotes the melting of paraffins at these temperatures. The first supply unit is hereinafter also referred to as electric fuel pump. The second supply unit is hereinafter also referred to as high-pressure pump.

It is especially advantageous if a setpoint value for the pressure in the return line is determined on the basis of the return quantity. This allows a regulation of the return quantity.

It is advantageous if the first supply unit is controlled as a function of the comparison of the setpoint value with an actual value.

A simplified development results if the first supply unit is controlled as a function of the setpoint value.

It is advantageous if a setpoint value for a rotational speed for the first supply unit is specified as a function of the comparison of the setpoint value with an actual value or as a function of the setpoint value. This means that a setpoint value for the rotational speed of the electric fuel pump is specified based on the return quantity.

In one advantageous development, a required quantity (B), which is to be supplied by the first supply unit, is determined on the basis of the return quantity.

A precise control or regulation comes about if the operating mode of a high-pressure regulation, an operating point of the internal combustion engine, and/or the fluid level of the reservoir are/is evaluated as operating state. As an alternative or in addition to the operating point of the internal combustion engine, temperature values such as the fuel temperature, in particular, may be taken into account as well.

It is advantageous if the following operating types are differentiated. In a first operating mode of the high-pressure regulation, a first control element, which influences the fuel quantity supplied by the second supply unit, determines the rail pressure. This means that the regulation of the rail pressure is implemented only by means of the first control element. In a second operating mode of the high-pressure regulation, a second control element, which influences the fuel quantity released from a high-pressure region, determines the rail pressure. This means that the regulation of the rail pressure is implemented only by means of the second control element. In a third operating mode of the high-pressure regulation, the first control element, which influences the fuel quantity supplied by the second supply unit, and the second control element, which influences the fuel quantity released from a high-pressure region, determine the rail pressure. In other words, the regulation of the rail pressure is implemented jointly by the first control element and the second control element.

The first control element hereinafter is also referred to as metering unit. Such a metering unit influences the fuel quantity supplied by the high-pressure pump into the high-pressure region. This metering unit normally forms a structural unit together with the high-pressure pump. The second control element is hereinafter also referred to as high-pressure control valve. The high-pressure control valve connects the fuel distributor and the reservoir as a function of its control signal. The method according to the present invention is not restricted to the use of a metering unit and a high-pressure control valve. If applicable, making corresponding changes, it may also be used in connection with other control elements.

DETAILED DESCRIPTION OF THE INVENTION

Figure 1:
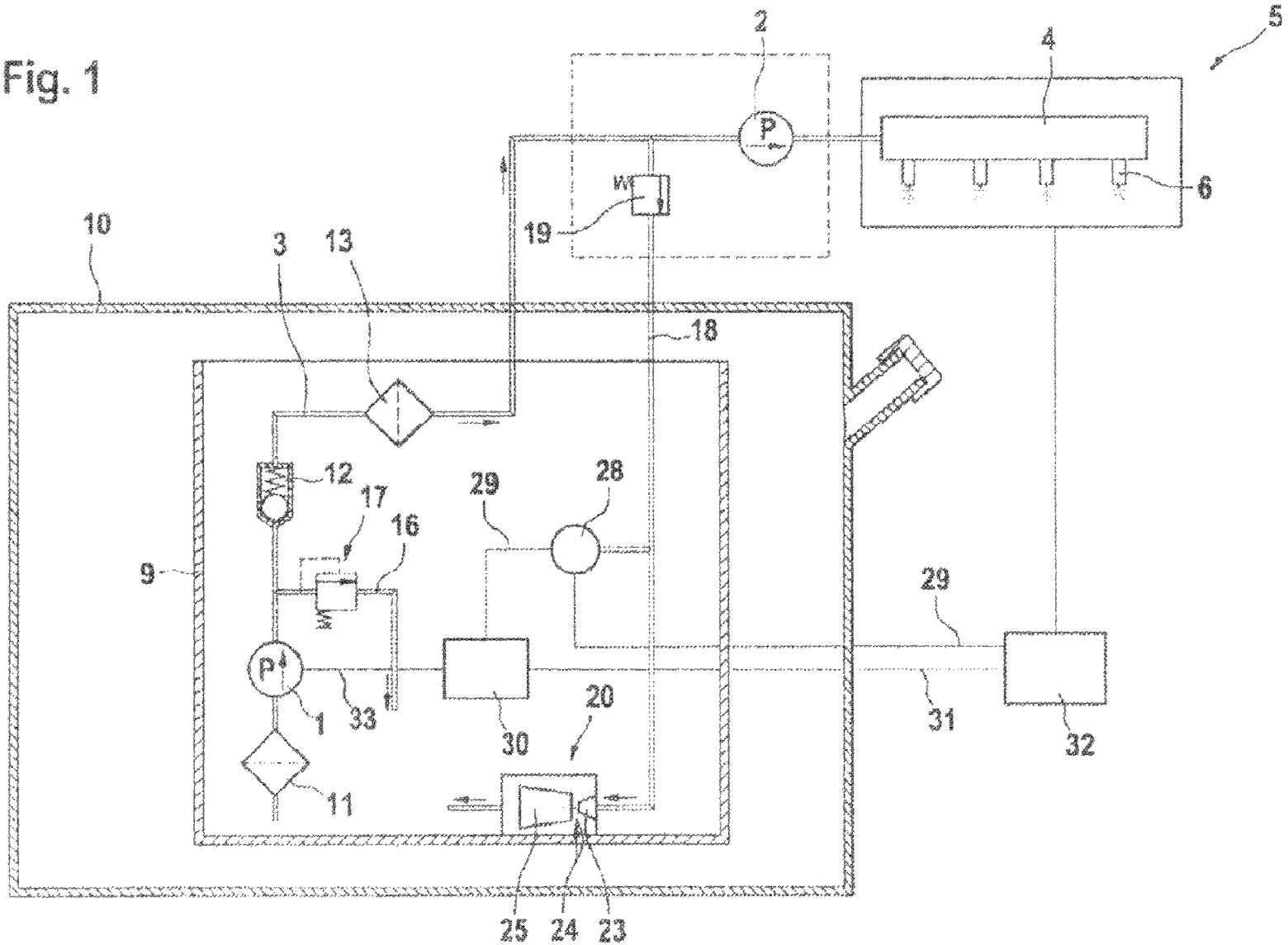
FIG. 1 shows a block diagram of the device according to the present invention.

FIG. 1, by way of example, shows a device for supplying fuel.

The device for supplying fuel has a first supply unit 1, e.g., an electric fuel pump used as presupply pump, for instance, and a second supply unit 2 fluidically connected to first supply unit 1 via a pressure line 3, which, for example, is a high-pressure pump operating according to the displacement principle. In this manner the two supply units 1, 2 are connected in series. Second supply unit 2 conveys the fuel supplied by first supply unit 1 at increased pressure into a fuel distributor 4 of an internal combustion engine 5, for example. Fuel distributor 4 is fludically connected to fuel injectors 6, which inject the fuel into a combustion chamber (not shown) of internal combustion engine 5.

First supply unit 1 is disposed in a reservoir 9, for example, which in turn is provided inside a storage container 10. First supply unit 1 aspirates fuel from reservoir 9, via a prefilter 11, for example, and supplies it via pressure line 3 to second supply unit 2. Prefilter 11 protects the device downstream from prefilter 11 from coarse dirt particles contained in the fuel. Provided in pressure line 3 is a non-return valve 12, for example, so that no fuel will flow back from downstream of non-return valve 12 to upstream from non-return valve 12. In addition, a main filter 13, for example, is provided in pressure line 3 downstream from non-return valve 12, which filters fine dirt particles from the fuel. Downstream from first supply unit 1 and upstream from non-return valve 12, an overpressure line 16 branches off from pressure line 3 and leads back into reservoir 9. Situated in overpressure line 16 is an overpressure valve 17, which opens at a predefined overpressure in pressure line 3 and allows fuel to flow off from pressure line 3 via overpressure line 16. Overpressure valve 17 is a safety valve which prevents the generation of impermissibly high pressures in pressure line 3 due to malfunctions, which could damage the device.

Reservoir 9 in the shape of a cup, for instance, stores sufficient fuel to ensure that a fuel supply of internal combustion engine 5 by supply units 1, 2 can take place even during cornering and given the sloshing motions of the fuel that occur in reservoir 10 as a result.

Branching off from pressure line 3, downstream from non-return valve 12 and downstream from main filter 13, is a return line 18, which leads back to reservoir 9 or storage container 10. A pressure control valve 19 is disposed in return line 18, for example, which regulates the pressure in pressure line 3 to a predefined operating pressure by opening at the predefined operating pressure in pressure line 3 and allowing the fuel to drain from pressure line 3 via return line 18. Below the predefined operating pressure, pressure control valve 19 is closed, and at a value that is equal to or above the predefined operating pressure, it is open.

The fuel returning to reservoir 9 via return line 18 is utilized for driving a known sucking jet pump 20, which supplies fuel from storage container 10 into reservoir 9. To ensure that reservoir 9 is kept filled, regardless of the fluid level of storage container 10, and does not run empty, the fuel quantity removed by first supply unit 1 from reservoir 9 has to be replenished in reservoir 9. To enable sucking jet pump 20 to generate the required output, it must be supplied with the necessary propellant jet quantity from return line 18. As is generally known, sucking jet pump 20 is equipped with a throttle element, e.g., a nozzle 23, via which the fuel of return line 18 reaches suction chamber 24 fluidically connected to storage container 10. The propellant jet emerging from nozzle 23 into suction chamber 24 carries along fuel from suction chamber 24, so that the fuel of the propellant jet and the carried-along fuel enter reservoir 9 via a mixing channel 25 in the known manner.

Preferably, a pressure sensor 28 is provided, which measures a pressure in return line 18 downstream from pressure control valve 19, the measured pressure being used as controlled variable for regulating first supply unit 1. First supply unit 1 is controlled in such a way that the pressure in return line 18 is adjusted to a predefinable value.

Pressure sensor 28 is situated and fixed in place on return line 18, for instance. Pressure sensor 28 is connected to an electronic control device via a first signal line 29. The electronic control device may be a pump control device 30 controlling first supply unit 1 via a control line 33, or it may be an engine control device 32 controlling the functions of internal combustion engine 5. Electronic control device 30, 32 regulates the output, e.g., the rotational speed, of first supply unit 1 in such a way that a predefined pressure is adjustable in return line 18. This demand-controlled regulation of first supply unit 1 is implemented by what is known as pulse-width modulation, for example. The demand-controlled regulation of first supply unit 1 increases the service life of first supply unit 1 and the efficiency of the device according to the present invention, and it achieves fuel savings.

For example, electronic pump control device 30 is connected to electronic engine control device 32 via a second signal line 31.

The basic idea of the method according to the present invention is that the supply quantity, which is also referred to as required quantity B and supplied by the electric fuel pump, is calculated, and that the electric fuel pump is controlled so as to supply this fuel quantity. Two developments are provided in this context. For one, the electric fuel pump may be controlled to the determined value as required quantity B. As an alternative, it is possible to determine setpoint value PS for the pressure in the return line based on a calculated return quantity MR of the overall system, and to adjust this setpoint value.

In both developments, return quantity MR is determined as a function of the operating state of the fuel-supply system. In one development, it is provided that required quantity B of the electric fuel pump is calculated based on the return quantity, and the electric fuel pump is controlled accordingly. In a second development it is provided that required return pressure PS is determined based on return quantity MR, and this pressure is then adjusted or, in a simple development, this pressure is set in a controlled manner.

Required quantity B of the electric fuel pump results from the addition of return quantity MR and required engine quantity BM. Required engine quantity BM essentially is the fuel quantity per time that is injected into the combustion chambers of the internal combustion engine. This variable is preferably determined on the basis of the parameters of injection quantity per injection, engine speed, number of cylinders, and fuel density. Injection quantity QK is normally available in the engine control device as internal variable and is used for controlling or generating the control signal of the actuators determining the fuel quantity reaching the combustion chambers.

In the following text, the determination of setpoint pressure PS will be described with the aid of the block diagram according to FIG. 2.

A first calculation 200 calculates a first return quantity MHD1. A second calculation 210 calculates a second return quantity MHD2, and a third calculation 220 calculates a third return quantity MHD3. These three signals reach a switching means 230, which is controlled by a control 235. Depending on the control signal of control 235, one of the three return quantity signals reaches a block 240. A return quantity signal MHD is then applied at the output of block 240. A fourth calculation 250 specifies a fourth return quantity MS. This quantity corresponds to the fuel quantity required to lubricate the high pressure pump and to cool it. The two signals MS and MHD reach a node 255, where they are linked, preferably in an additive manner. The output signal of node 255 reaches a block 260, at whose output signal BCR is applied, which corresponds to the required quantity of the common rail system. A fifth calculation 270 determines a required quantity BS. Required quantity BS and return quantity BTR reach a maximum selection 275. Maximum selection 275 selects the larger of the two signals and forwards it to block 280. Return quantity MR is applied at the output of block 280. In addition to block 280, a temperature correction 285 applies input signals to a jet pump characteristic map 290. Output signal PS of jet pump characteristic map 290 as setpoint value reaches a controller 295. An output signal P of pressure sensor 28 is applied at the second input of controller 295. In one development, there is the option of not providing a sucking jet pump. It is then replaced by a replacement throttle. In this case characteristic map 290 takes the characteristic of the replacement throttle into account.

Figure 3:
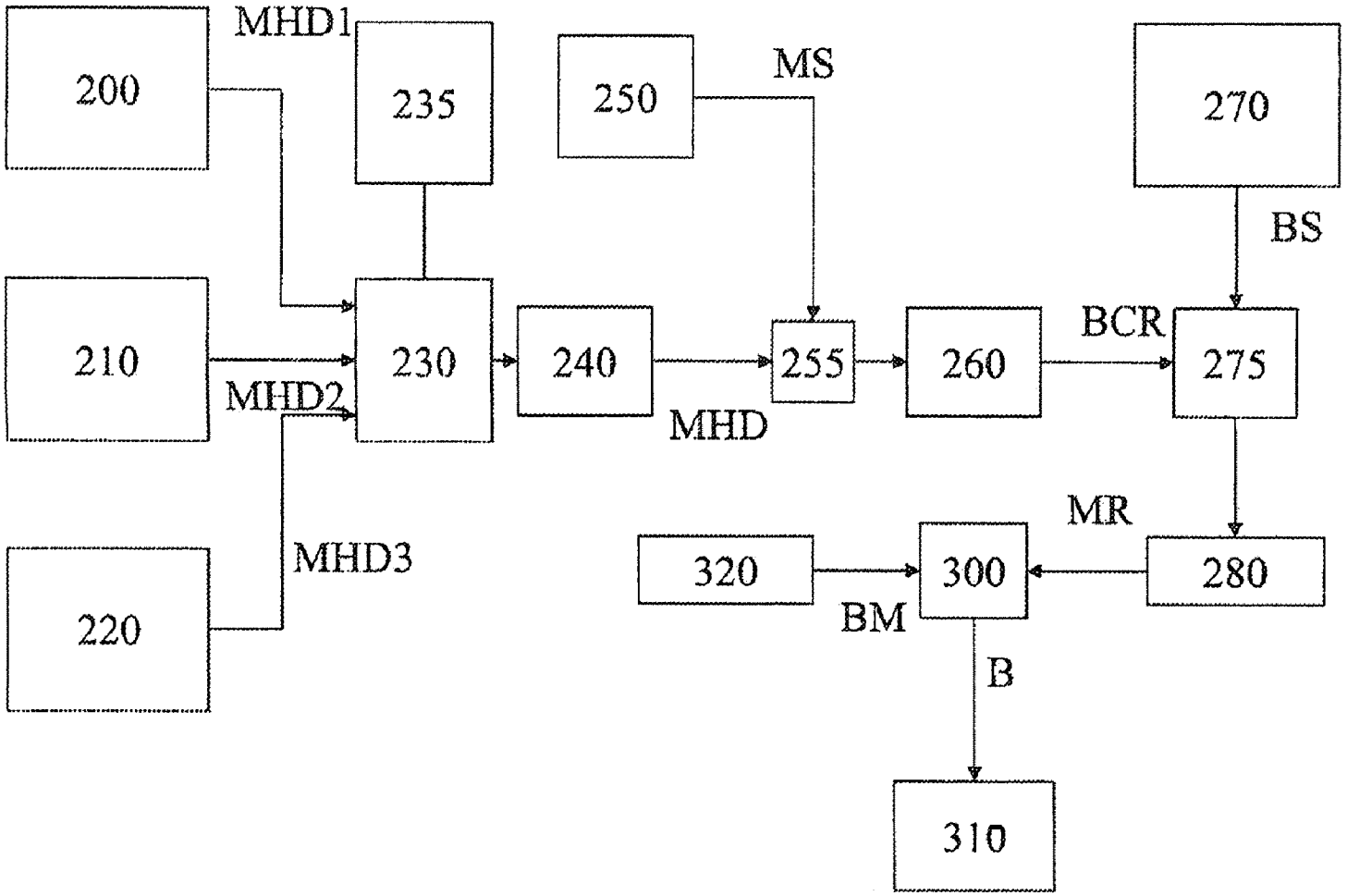

With the aid of FIG. 3, the following text describes a development in which a required quantity B for the electric fuel pump is specified on the basis of return quantity MR.

Figure 2:
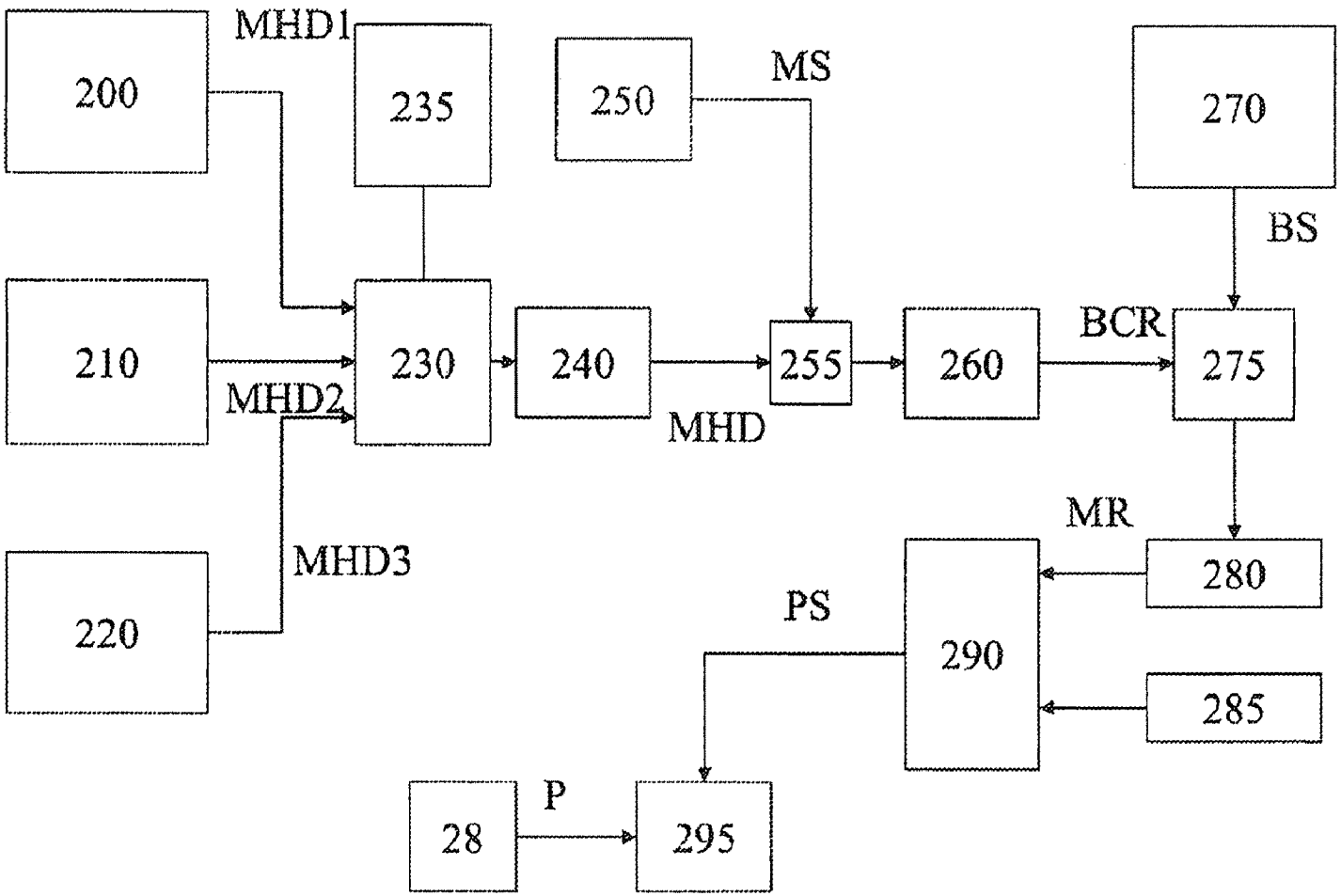
FIGS. 2 and 3 show two example methods of the control according to the present invention.

This development differs from the development according to FIG. 2 only in the further processing of output signal MR of block 280.

Output signal MR of block 280 reaches an electric fuel-pump control 310 via a node 300. Applied at the second input of node 300 is the output signal of a sixth calculation, which specifies required quantity BM of the internal combustion engine. Based on required quantity BM and return quantity MR, summing point 300 calculates required quantity B of the electric fuel pump. The control of the electric fuel pump by control 310 then takes place as a function of this signal.

According to the present invention, the return quantity of the high-pressure region of the common rail system is calculated in the first, second and third calculations in both developments. Here, a distinction is made between different operating states of the fuel-supply system. In particular different operating modes of the pressure-regulation system of the common rail system are considered different operating states of the fuel-supply system.

A separate calculation is provided for each operating mode of the pressure-regulation system, which calculates return quantity MHD based on the marginal conditions of the particular operating mode. In the development illustrated, a distinction is made between three different operating modes of the pressure-regulation system. Given an appropriate configuration, more or also only two operating modes may be taken into account. A corresponding number of calculations must then be provided.

In the first calculation, an operating mode in which a pressure regulation is implemented using one high-pressure control valve only is considered. With the aid of this high-pressure control valve, fuel is released from the high-pressure region into the low-pressure region and the pressure is adjusted in this manner. There is no provision for influencing of the supply quantity of the high-pressure pump. The high-pressure pump preferably supplies the maximum quantity. In this operating mode return quantity MHD1 is specified in first calculation 200 in that the geometrical supply volume of the high-pressure pump and the rotational speed of the high-pressure pump are considered. In so doing, the return quantity results from the product of the geometrical supply volume of the high-pressure pump, multiplied by the rotational speed of the pump. The rotational speed of the high-pressure pump is a function of the engine speed. This quantity calculated in this manner corresponds to the quantity supplied by the high-pressure pump. The required engine quantity is then also deducted from this fuel quantity. In other words, the return quantity corresponds to the difference between the quantity supplied by the high-pressure pump and the quantity which is injected into the combustion chambers.

In addition, the injector return quantity must be taken into account. This injector return quantity includes the leakage amounts of the injectors and the control quantity of the injectors. Depending on whether injectors with or without leakage are installed in the CR system, the injector return quantity includes the control quantity and additionally the leakage amounts of the injectors.

Furthermore, the type of return of this injector return quantity into the low-pressure region must be considered.

In a second operating mode of the rail-pressure control system, only a so-called metering unit influences the rail pressure. The quantity provided to the high-pressure pump is controlled with the aid of such a metering unit. In this operating mode the pressure-control valve is closed. In this operating mode, the return quantity is determined from second calculation 210 and/or the injector return quantity.

The control quantity of the injectors is essentially a function of the required engine quantity, and the injector leakage amount is essentially a function of the rail pressure and the temperature.

In a third operating mode, the pressure regulation is implemented by controlling both the metering unit and the high-pressure control valve. In this operating mode the third calculation specifies the return quantity as a function of the controlled variable of the metering unit and the required engine quantity; if applicable, the injector return quantity, in particular the control quantity of the injectors, is taken into account as well.

When determining return quantity MHD, a distinction is made between different variants of the CR system.

In a first variant leakage-free injectors are used. The injector control quantity is not returned to reservoir 9 but to the intake to the high-pressure pump, e.g., into line 3. The deactivation quantity of the high-pressure control valve together with the return quantity of the high-pressure pump flows into the storage container. The return quantity of the high-pressure region depends on the type of high-pressure regulation.

In the pressure regulation via the high-pressure control valve, return quantity MHD is calculated from the geometrical supply volume of the high-pressure pump, multiplied by the rotational speed of the high-pressure pump, minus the required engine quantity and the control quantity of the injectors. In a pressure regulation via a volume control of the high-pressure pump by means of the metering unit, the return quantity is zero.

When combining both control strategies, the return quantity is determined on the basis of the controlled variable of the metering unit minus the required engine quantity and the control quantity of the injectors.

A second variant utilizes injectors having leakage. The injector leakage and the injector control quantity together with the deenergization quantity of the high-pressure valve and the return quantity of the high-pressure pump jointly flow back to storage container 10. In this variant the determination of required quantity MDH is a function of the type of high-pressure regulation.

In a pressure regulation via the high-pressure control valve, the return quantity is calculated from the geometrical supply volume, multiplied by the rotational speed of the high-pressure pump, minus the required engine quantity.

In a pressure regulation via the volume control of the high-pressure pump, the return quantity results from the sum of the control quantity of the injectors and the injector leakage amount.

When combining both control strategies, the return quantity is determined on the basis of the controlled variable of the metering unit, minus the required engine quantity.

The control quantity of the injectors essentially depends on the injected fuel quantity. The injector leakage amount is essentially a function of the rail pressure and the temperature. The fuel temperature is preferably used as temperature.

A third variant corresponds to the first variant; however, the deenergization quantity of the high-pressure control valve is returned into intake 3 to the high-pressure pump. In this variant the return quantity is always zero, regardless of the control concept.

A fourth variant corresponds to the second variant, but provides for a return of the deenergization quantity of the high-pressure control valve into the intake to the high-pressure pump. The return quantity of the high-pressure region is always the sum of the control quantity of the injectors and the injector leakage quantity, regardless of the control concept.

Depending on the operating mode of the high-pressure control, control 235 triggers switching means 230 in such a way that the output signal of the corresponding calculation is selected.

Fourth calculation 250 calculates the fuel quantity required for lubricating and cooling the high-pressure pump, which is referred to as return quantity MS.

In a first example embodiment, return quantity MS required for cooling and lubricating the high-pressure pump is preferably specified by fourth calculation 250 at least as a function of the temperature. Depending on the pump used, and/or the development of the hydraulic circuit, a temperature-dependent value is specified for the so-called lubrication quantity, and a constant value for the so-called cooling quantity. Return quantity MS preferably results from an addition of the two values.

It is not necessary for return quantity MS to be calculated by summing up the lubrication quantity, the cooling quantity, and/or the leakage quantity. It may also be provided to specify the return quantity as a function of at least one of the variables of temperature, load, engine speed, and/or rail pressure, in particular stored in a characteristic map. This procedure is able to improve the dynamic response. Used as load is, in particular, a load variable used for controlling the internal combustion engine such as the injected fuel quantity, for example, or a variable determined on the basis of these variables.

In one particularly advantageous development, an increased value for the cooling quantity is specified for particular values of the engine speed and the load. In particular, it is provided that an increased cooling quantity is specified at high engine speeds and low loads. Overall, this results in a return quantity MS that is as function of at least the engine speed and the load.

In a further advantageous development, return quantity MS is specified as a function of at least the rail pressure and the temperature. This is advantageous especially for certain constructive developments of the hydraulic circuit. For this purpose, for instance, a leakage quantity is specified a function of at least the rail pressure and the temperature. Return quantity MS then results from, for example, an addition of the leakage amount and the value, determined as described above, for return quantity MS. Overall, this results in a return quantity MS that is as function of at least the temperature and the rail pressure.

This return quantity MS required for cooling and lubricating the high-pressure pump is specified at least as a function of the temperature; as an alternative or in addition to the temperature, one or more of the variables of loading of the internal combustion engine, engine speed, and/or rail pressure may be considered as well.

Node 255 sums up the return quantity of high-pressure region MHD and return quantity MS required for cooling and lubrication. The output signal of node 255 reaches block 260, which provides required quantity BCR of the common rail system. Required quantity BCR of the common rail system is the particular fuel quantity to be supplied by the electric fuel pump without an injection taking place; in other words, this is the fuel quantity released by the high-pressure control valve, which returns to the low-pressure region again as control or leakage quantity of the injectors, and/or which is required to cool and lubricate the high-pressure pump.

Fuel-metering systems are frequently equipped with a return-driven tank jet pump. These require a minimum return quantity to enable these tank jet pumps or sucking jet pumps to supply fuel from the storage container into reservoir 9. Fifth calculation 270 calculates the return quantity required by the sucking jet pump in order to enable it to generate the required pumping capacity. The required sucking capacity of the sucking jet pump corresponds to the required engine quantity. The fuel quantity injected into the internal combustion engine must be conveyed from storage container 10 into reservoir 9. Fifth calculation 270 calculates necessary required quantity BS of the sucking jet pump from the known suction-propellant quantity characteristic of the sucking jet pump as a function of the temperature. Using a characteristic map included in fifth calculation 270, this calculation is preferably carried out as a function of the required engine quantity and the temperature.

Maximum selection 275 then selects the greater of the two signals of the required quantity of sucking jet pump BS or the required quantity of common rail system BCR. A signal selected in this manner then corresponds to return quantity MR to be supplied by the electric fuel pump. This signal is subsequently conveyed from block 280 to jet pump characteristic map 290. Furthermore, this characteristic map processes a temperature variable of temperature correction 285. On the basis of these two input variables, jet pump characteristic map 290 specifies a setpoint pressure PS for the return pressure in the return line. This setpoint pressure is then forwarded to controller 295, which sets this setpoint pressure by inputting corresponding controlled variables. Preferably, this takes place with the aid of a regulation, which determines the controlled variable as a function of the comparison between setpoint value PS and actual value P for the return pressure.

In the example development according to FIG. 3, the required quantity of internal combustion engine BM is added to the required return quantity in node 300. This required quantity is preferably provided by engine control 320. The result is required quantity B of the electric fuel pump. On the basis of this required quantity B of the electric fuel pump, the control of the electric fuel pump is then implemented in block 310.

What is claimed is:

1. A method for controlling a fuel-supply system of an internal combustion engine, the method comprising:

actuating a first supply unit to supply fuel from a storage container to a second supply unit, wherein:

at least a portion of the fuel supplied by the first supply unit returns as return quantity into the storage container via a return line;

the second supply unit is situated, with respect to a fuel flow direction, downstream of the first supply unit, downstream of the storage container, and upstream of a combustion engine;

at least one fuel injector is situated downstream of the second supply unit; and fuel is supplied by the second supply unit to the combustion engine;

determining the return quantity as a function of the operating state of the fuel-supply system;

determining a required quantity based on the return quantity;

controlling the first supply unit to supply at least the determined required quantity.

2. The method as recited in claim 1, further comprising:

determining a setpoint value for the pressure in the return line as a function of the return quantity.

3. The method as recited in claim 2, wherein the first supply unit is controlled as a function of a comparison of the setpoint value with an actual value of the pressure in the return line.

4. The method as recited in claim 2, further comprising:

specifying a setpoint value for a rotational speed for the first supply unit as a function of one of (i) the setpoint value for the pressure, or (ii) a comparison of the setpoint value for the pressure with an actual value of the pressure in the return line.

5. The method as recited in claim 1, wherein the operating state of the fuel-supply system is determined from at least one of an operating mode of a high-pressure regulation, an operating point of the internal combustion engine, and the fluid level of the storage container.

6. The method as recited in claim 5, wherein a first control element configured to influence the fuel quantity supplied by the second supply unit determines a rail pressure in a first operating mode of the high-pressure regulation.

7. The method as recited in claim 5, wherein a second control element configured to influence the fuel quantity released from a high-pressure region determines a rail pressure in a second operating mode of the high-pressure regulation.

8. The method as recited in claim 5, wherein a first control element configured to influence the fuel quantity supplied by the second supply unit and a second control element configured to influence the fuel quantity released from a high-pressure region determine a rail pressure in a third operating mode of the high-pressure regulation.

9. The method as recited in claim 5, wherein the operating point of the internal combustion engine is determined as a function of at least one of injected fuel quantity, rotational speed of the internal combustion engine, load, rail pressure, and temperature.

10. The method as recited in claim 1, wherein the first and second supply units are fuel pumps.

11. The method as recited in claim 1, wherein the fuel from the storage container is prefiltered before being supplied by the first supply unit.

12. The method as recited in claim 1, wherein an overpressure valve is situated next to the first supply unit, the overpressure valve opening at a predefined overpressure to allow the fuel to flow off via an overpressure line.

13. The method as recited in claim 1, wherein the fuel supplied by the first supply unit to the second supply unit is supplied through a filter.

14. The method as recited in claim 1, wherein the determining of the fuel quantity is performed by respective differing methods of calculation for respective ones of predefined operating states.

15. The method as recited in claim 2, wherein the first supply unit is controlled additionally as a function of the setpoint value.

16. A fuel-supply system of an internal combustion engine, the fuel-supply system comprising:

a first supply unit;

a second supply unit situated, with respect to a fuel flow direction, downstream of the first supply unit, downstream of a storage container, upstream of a combustion engine to which the second supply unit supplies fuel, and upstream of at least one fuel injector;

means for actuating the first supply unit to supply fuel from the storage container to the second supply unit, wherein at least a portion of the fuel supplied by the first supply unit returns as return quantity into the storage container via a return line;

means for determining the return quantity as a function of the operating state of the fuel-supply system;

means for determining a required quantity based on the return quantity; and means for controlling the first supply unit to supply at least the determined required quantity.

17. The device as recited in claim 16, further comprising:

an arrangement for determining a setpoint value for the pressure in the return line as a function of the return quantity.

18. The device as recited in claim 17, wherein the first supply unit is controlled as a function of a comparison of the setpoint value with an actual value of the pressure in the return line.

19. The device as recited in claim 17, further comprising:

an arrangement for specifying a setpoint value for a rotational speed for the first supply unit as a function of one of (i) the setpoint value for the pressure, or (ii) a comparison of the setpoint value for the pressure with an actual value of the pressure in the return line.

20. The device as recited in claim 16, further comprising:

an arrangement for determining the operating state of the fuel-supply system from at least one of an operating mode of a high-pressure regulation, an operating point of the internal combustion engine, and the fluid level of the storage container.

21. The device as recited in claim 20, further comprising:

a first control element configured to influence the fuel quantity supplied by the second supply unit and to determine a rail pressure in a first operating mode of the high-pressure regulation.

22. The device as recited in claim 20, further comprising:

a second control element configured to influence the fuel quantity released from a high-pressure region to determine a rail pressure in a second operating mode of the high-pressure regulation.

23. The device as recited in claim 20, further comprising:

a first control element configured to influence the fuel quantity supplied by the second supply unit; and a second control element configured to influence the fuel quantity released from a high-pressure region to determine a rail pressure in a third operating mode of the high-pressure regulation.

24. The device as recited in claim 20, further comprising:

an arrangement for determining an operating point of the internal combustion engine as a function of at least one of injected fuel quantity, rotational speed of the internal combustion engine, load, rail pressure, and temperature.

25. The device as recited in claim 16, wherein the first and second supply units are fuel pumps.

26. The device as recited in claim 16, wherein the fuel from the storage container is prefiltered before being supplied by the first supply unit.

27. The device as recited in claim 16, wherein an overpressure valve is situated next to the first supply unit, the overpressure valve opening at a predefined overpressure to allow the fuel to flow off via an overpressure line.

28. The device as recited in claim 16, wherein the fuel supplied by the first supply unit to the second supply unit is supplied through a filter.

29. The device as recited in claim 17, wherein the first supply unit is controlled additionally as a function of the setpoint value.

* * * * *